United States Patent [19]
Hoskinson
[11] 4,318,211
[45] Mar. 9, 1982

[54] CRIMPING TOOL FOR AUTOMOBILE DOOR PANELS

[76] Inventor: James Hoskinson, 10118 Duck Creek Rd., Salem, Ohio 44460

[21] Appl. No.: 163,068

[22] Filed: Jun. 26, 1980

[51] Int. Cl.[3] ..... B23P 11/00
[52] U.S. Cl. ..... 29/243.5; 29/243.58
[58] Field of Search ..... 29/243.5, 243.57, 243.58, 29/283.5, 268; 72/409

[56] References Cited

U.S. PATENT DOCUMENTS

| | | | |
|---|---|---|---|
| 421,187 | 2/1890 | Myers | 113/56 |
| 1,840,755 | 1/1932 | Tiernan et al. | 29/243.57 |
| 2,143,339 | 1/1939 | Wiese | 113/56 |
| 3,166,961 | 1/1965 | Chaplin, Sr. | 81/15 |
| 3,602,032 | 8/1971 | Skintzis | 29/243.58 |
| 3,961,518 | 6/1976 | Osbolt | 72/409 |

*Primary Examiner*—James L. Jones, Jr.
*Attorney, Agent, or Firm*—Harpman & Harpman

[57] ABSTRACT

A hand operated tool for crimping the edges of automobile door outer replacement panels over the door frame has a pair of levers pivoted to one another with the pivoted ends of the levers defining holding and crimping jaws, the holding jaw positioned for engagement against a flanged replacement panel edge and the crimping jaw having a configuration engaging and holding the edge of the door panel while moving it into smooth underlying tightly engaged relation to the door frame.

4 Claims, 5 Drawing Figures

CRIMPING TOOL FOR AUTOMOBILE DOOR PANELS

BACKGROUND OF THE INVENTION (1) Field of the Invention:

This invention relates to tools for attaching sheet metal replacement panels sometimes known as skins to an automobile door frame.

(2) Description of the Prior Art:

Prior tools include those illustrated in U.S. Pat. No. 3,961,518, which attempts to accomplish the same purpose by different mechanical arrangements. The sheet metal fastener bender of U.S. Pat. No. 3,166,961 forms a U-shaped bend in the sheet metal work piece.

In the present invention, the pair of levers are provided with jaw configurations that position the tool in the proper location and move the edge flange of the replacement panel inunder the flanged door frame. The crimping jaw is notched to provide two areas of contact with the edge flange as it is being crimped into desirable position.

SUMMARY OF THE INVENTION

A crimping tool for automobile outer door panels has a pair of levers pivoted to one another adjacent one of the their ends with the ends adjacent the pivot forming a holding jaw and a crimping jaw respectively. The configuration of the holding jaw locates the tool relative to the flanged edge of a replacement door panel to be crimped and the crimping jaw has a configuration that engages the flange to be crimped in two areas as it moves in a crimping action, the first of these engaging the flange near its longitudinal edge and thereby folding or bending the whole flange evenly and smoothly and the second area moving into engagement with the folded or crimped flange in the final crimping stages to insure an even tightly crimped fastening of the flange of the door panel to the flanged door frame.

DESCRIPTION OF THE PREFERRED EMBODIMENT

Figure 1:
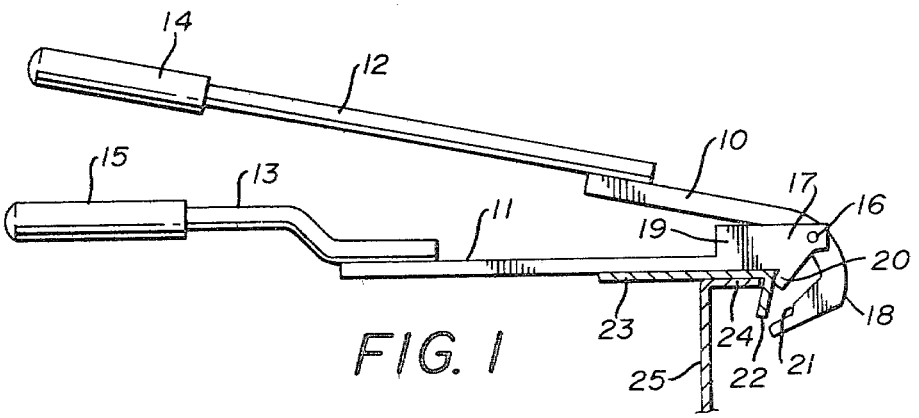
FIG. 1 is a side view of the crimping tool positioned on portions of a replacement panel and door frame.
Figure 2:
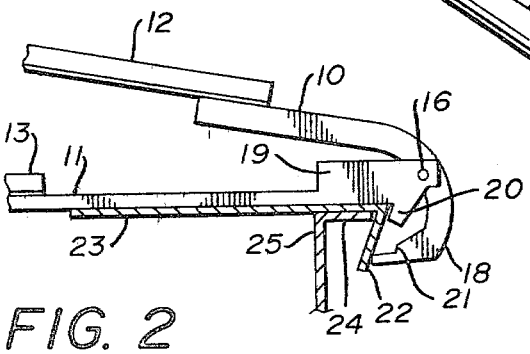
FIG. 2 is a view similar to FIG. 1 showing the crimping tool with parts broken away and the jaws initially engaging the work piece.
Figure 3:
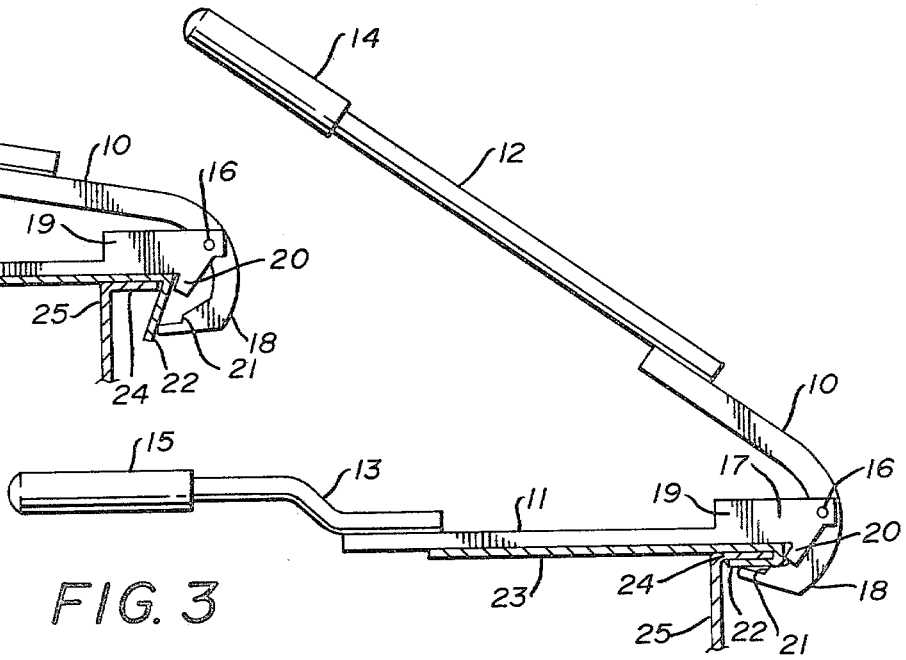
FIG. 3 is a view similar to FIG. 1 showing the jaws in the final crimping position.
Figure 4:
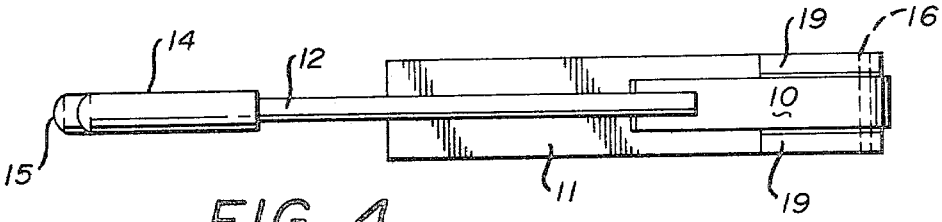
FIG. 4 is a top plan view of the tool seen in FIGS. 1 and 3.
Figure 5:
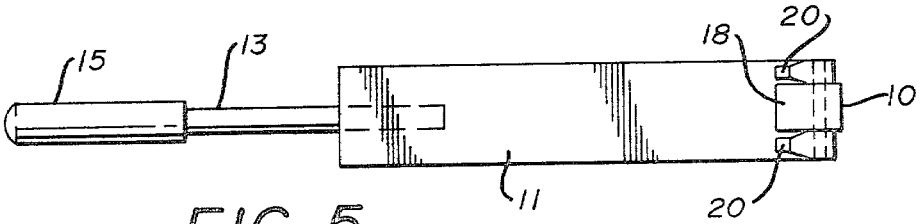
FIG. 5 is a bottom plan view thereof.

By referring to the drawings and FIGS. 1, 2 and 3 in particular, it will be seen that the crimping tool comprises a pair of levers 10 and 11, each of which has an extension 12 and 13 respectively, termininating in a handle portion 14 and 15 respectively. The other ends of the levers 10 and 11 are pivoted to one another by a pivot 16 and said other ends are shaped to form a holding jaw 17 and a crimping jaw 18. The holding jaw 17 has a pair of transversely spaced upstanding sections 19, the forward ends of which are apertured and receive the pivot 16, the spacing being sufficient to receive the lever 10 as seen in FIG. 4 of the drawings. The holding jaw 17 is also provided with a horizontally spaced pair of angularly disposed downwardly extending lugs 20 and they are also spaced apart sufficiently to permit the movement of the crimping jaw 18 therebetween as seen in FIGS. 3 and 5 of the drawings.

The crimping jaw 18, which is the end configuration of the lever 10, forms a semi U-shape curving inwardly and downwardly with respect to the pivot 16 and underlying the holding jaw 17.

As best seen in FIGS. 1 and 2 of the drawings, the upper inner surface of the crimping jaw 18 is provided with a transversely extending notch 21 which divides the metal engaging portions of the crimping jaw 18.

Still referring to FIGS. 1, 2 and 3 of the drawings, it will be seen that as shown in FIG. 1, the lugs 20 of the lever 11 are engaged against the downturned flange 22 of an outer replacement door panel 23 which has been positioned over a flange 24 of the automobile door frame 25 as will be understood by those skilled in the art, the lugs 20 holding the crimping tool in proper position and the holding action is facilitated and helped by the formation of the extension 13 in an offset configuration which enables the workman to hold the tool in the position shown during the crimping operation.

In FIG. 2 of the drawings, the lever 10 has been moved upwardly with respect to the position of FIG. 1 to bring the inner end of the crimping jaw 18 into engagement with the flange 22 of the replacement panel 23 to begin to bend it or crimp it inunder the flange 24 of the automobile door frame 25. It will be seen that the outermost end portion of the crimping jaw 18 engages the flange 22 adjacent its longitudinal edge so as to insure the even bending and crimping of the entire flange 22 inunder the door frame flange 24.

By referring now to FIG. 3 of the drawings, the lever 10 will be seen to have been moved further in an upwardly direction with respect to the lever 11 so as to cause the crimping jaw 18 to engage the flange 22 of the replacement panel 23 in two areas, one on either side of the transverse notch 21 and thus hold all of the flange 22 as it is crimped smoothly and evenly up and inunder the flange 24 of the door frame 25.

The configuration of the crimping jaw 18 with its outermost end portion being of a different thickness than its inner portion and the portions separated by the transverse notch 21 insures the retention of the tool against the flange 22 of the replacement door panel during the crimping operation and results in an even bending and crimping action.

Those skilled in the art will understand that the tool is progressively moved along the edge of the replacement panel and the crimping operation repeated at spaced intervals until all of the peripheral flange of the replacement door panel is properly and attractively folded under and crimped tightly against the flanged door frame.

The configuration of the crimping jaw 18 and its engaging relation to the flange 22 of the replacement door panel 23 insures a tight stretched evenly applied replacement panel which is highly desirable in the art.

In FIG. 4 of the drawings, the top plan view shows the relative width of the levers 10 and 11 and the arrangement of the lever 10 between the upstanding sections 19 of the lever 11 and in FIG. 5 of the drawings the bottom plan view, the outermost end of the curved crimping jaw 18 as well as the intermediate portions thereof are shown in position between the angularly disposed downwardly extending lugs 20. The sections 19 and the lugs 20 insure the desirable pivoting action of the jaw ends of the levers with respect to one another and prevent sideward slippage of the jaws during the crimping operation as hereinbefore explained.

Although but one embodiment of the present invention has been illustrated and described, it will be apparent to those skilled in the art that various changes and modifications may be made therein without departing from the spirit of the invention and having thus described my invention what I claim is:

1. A tool for crimping the flanged edge of a replacement door panel on a flanged door frame of an automobile comprising a pair of levers, a first one of which has a straight end, a holding jaw on said straight end, means on said holding jaw for engaging said flanged edge of said replacement door panel, the other of said pair of levers having a curved end of semi-U shape forming a crimping jaw, pivot means engaging said holding jaw adjacent its outermost end relative to said lever and engaging said curved end of said other lever substantially midway of said curved end so that the crimping jaw formed by said curved end is movable on an arc toward and away from said holding jaw in overlapping relation to said flanged edge of said replacement door panel and the flanged door frame when said levers are moved relative to one another.

2. The tool set forth in claim 1 and wherein said means on said holding jaw for engaging said flanged edge of said replacement door panel comprises a pair of transversely spaced lugs, the spacing of said lugs being such that said crimping jaw is movable in the area therebetween.

3. The tool set forth in claim 1 and wherein said holding jaw has a pair of upstanding sections spaced transversely and said said upstanding sections.

4. The tool set forth in claim 1 and wherein said crimping jaw formed by said curved end has spaced work engaging surfaces separated by a transverse groove whereby one portion of said crimping jaw initially engages said flanged edge of said replacement door panel adjacent the longitudinal edge thereof.

* * * * *